US008640922B2

(12) United States Patent
Jutzi

(10) Patent No.: US 8,640,922 B2
(45) Date of Patent: Feb. 4, 2014

(54) MULTICOMPONENT CARTRIDGE WITH VENTING APPARATUS

(75) Inventor: Paul Jutzi, Wilen bei Wollerau (CH)

(73) Assignee: Sulzer Mixpac AG, Haag (CH)

( * ) Notice: Subject to any disclaimer, the term of this patent is extended or adjusted under 35 U.S.C. 154(b) by 7 days.

(21) Appl. No.: 13/376,667

(22) PCT Filed: May 31, 2010

(86) PCT No.: PCT/EP2010/057512

§ 371 (c)(1),
(2), (4) Date: Dec. 7, 2011

(87) PCT Pub. No.: WO2010/145932

PCT Pub. Date: Dec. 23, 2010

(65) Prior Publication Data

US 2012/0080447 A1 Apr. 5, 2012

(30) Foreign Application Priority Data

Jun. 18, 2009 (EP) ..... 09163156

(51) Int. Cl.
*B67B 7/70* (2006.01)

(52) U.S. Cl.
USPC ..... 222/137; 222/326; 222/386; 222/481.5

(58) Field of Classification Search
USPC ..... 222/94, 129, 135, 137, 325–327, 481.5, 222/386
See application file for complete search history.

(56) References Cited

U.S. PATENT DOCUMENTS 3,827,602 A 8/1974 Nicholls
4,566,610 A * 1/1986 Herb ..... 222/137
4,871,090 A * 10/1989 Hoffmann ..... 222/81
5,366,774 A * 11/1994 Pinto et al. ..... 428/36.92
5,443,181 A * 8/1995 Popp et al. ..... 222/95
5,697,524 A * 12/1997 Sedlmeier ..... 222/82
5,711,457 A * 1/1998 Wanbaugh et al. ..... 222/136
5,738,252 A * 4/1998 Dodd et al. ..... 222/376

(Continued)

FOREIGN PATENT DOCUMENTS

WO WO 91/05731 5/1991
WO WO 2005/005305 1/2005

OTHER PUBLICATIONS

International Search Report for International Application No. PCT/EP2010/057512 mailed on Sep. 21, 2010.

(Continued)

*Primary Examiner* — Frederick C Nicolas
(74) *Attorney, Agent, or Firm* — K&L Gates LLP

(57) ABSTRACT

A multicomponent cartridge includes a first storage chamber for a first component and a second storage chamber for a second component. The first storage chamber is separate from, and arranged next to, the second storage chamber. A first piston is movably received in the first storage chamber. A second piston is movably received in the second storage chamber. Each of the first or second storage chambers has a respective filling end and a respective discharge end. The storage chambers are connected to one another at at least the discharge end. The storage chambers have inner walls with the discharge end opening into a discharge element in an opening aperture. A venting element is upstream of the corresponding opening aperture at at least one of the inner walls, with the venting element extending over a maximum of one third of a longitudinal dimension of the storage chamber.

20 Claims, 5 Drawing Sheets

(56) References Cited

U.S. PATENT DOCUMENTS

| | | | | |
|---|---|---|---|---|
| 5,775,548 | A * | 7/1998 | Hohmann et al. | 222/376 |
| 5,779,108 | A * | 7/1998 | Barriac et al. | 222/340 |
| 5,813,784 | A * | 9/1998 | Durliat | 401/98 |
| 5,873,496 | A * | 2/1999 | Montaner et al. | 222/153.09 |
| 6,176,396 | B1 * | 1/2001 | Hamada et al. | 222/137 |
| 6,464,112 | B2 | 10/2002 | Summons et al. | |
| 6,848,480 | B2 * | 2/2005 | Brennan | 141/2 |
| 7,337,916 | B2 * | 3/2008 | Clougherty | 220/785 |
| 7,353,972 | B2 * | 4/2008 | Nehren | 222/386 |
| 7,506,783 | B2 * | 3/2009 | Brennan et al. | 222/137 |
| 7,681,762 | B2 * | 3/2010 | Bublewitz et al. | 222/153.09 |
| 8,074,843 | B2 * | 12/2011 | Keller | 222/137 |
| 8,100,295 | B2 * | 1/2012 | Keller | 222/137 |

OTHER PUBLICATIONS

Chinese Office Action issued Apr. 3, 2013 for corresponding Chinese Appln. No. 201080027696.7.

* cited by examiner

MULTICOMPONENT CARTRIDGE WITH VENTING APPARATUS

PRIORITY CLAIM

The present application is a National Stage of International Application No. PCT/EP2010/057512, filed on May 31, 2010, which claims priority to European Patent Application No. 09163156.4 filed on Jun. 18, 2009, the entire contents of which are being incorporated herein by reference.

The invention relates to a multicomponent cartridge which is suitable for the simultaneous dispensing of at least two components, with the dispensing of the two components taking place separately. The two components can be mixed only directly before use to be supplied to their intended use as a mixture.

Such a multicomponent cartridge is already known from WO9105731. This multicomponent cartridge includes a first hollow space and a second hollow space which can be filled with a respective component each. The first hollow space and the second hollow space have the shape of a cylinder and are arranged next to one another. Each of the two hollow spaces opens into a discharge nozzle through which a respective one of the components is discharged. A static mixer can be connected to the two discharge nozzles and the components being discharged separately through the discharge nozzles can be mixed with one another in it. Instead of the static mixer, a closure element can be connected to the discharge nozzles which serves for the closing of the two openings formed by the discharge nozzles. This closure element is required to store the two components separately in the first and second hollow spaces and to shield them from environmental influences such as light, atmosphere and the like.

A seal can be applied to the filling end of the first and second hollow spaces disposed opposite the discharge nozzles and likewise serves the purpose of storing the two components separately in the first and second hollow spaces. This seal is attached to the filling end subsequent to the filling of the first and second hollow spaces with the corresponding component. The filling of each of the two hollow spaces thus takes place at the filling end of the multicomponent cartridge. So that the seal can satisfy its purpose, no air may be enclosed between the seal and the corresponding component after the filling, that is means must be provided so that the air can escape before the conclusion of the filling. The seal is in direct contact with the corresponding component after the end of the filling. These means are described as venting grooves in WO9105731 which are applied in the wall of the first and second hollow spaces at the filling end. When the seal is thus inserted into the corresponding hollow space after conclusion of the filling, air located between the component and the seal can escape through the grooves.

It is disadvantageous in this structure that such an arrangement of venting grooves is ineffective on a filling via the corresponding discharge nozzle. A filling via the discharge nozzle is in particular carried out when the multicomponent cartridge is only filled briefly before use. The multicomponent cartridge is delivered in empty condition and is filled with the corresponding components directly before use by the user or by an intermediate dealer.

It is therefore the object of the invention to develop a multicomponent cartridge which can be filled from the discharge side, with air enclosed by the filler material at the start of the filling being able to escape before the filling is concluded.

The solution includes a multicomponent cartridge which includes a first storage chamber for a first component and a second storage chamber for a second component. The first component is separate from the second component in the storage condition. The first storage chamber is arranged next to the second storage chamber, with a first piston being movable received in the first storage chamber and a second piston being movably received in the second storage chamber. The first and second pistons are movable by means of a dispensing means such as a plunger or while applying pressure fluid to dispense the two components simultaneously.

Each of the first or second storage chambers has a respective filling end and a respective discharge end and the first and second storage chambers are connected to one another at least at the discharge end, with the first and second storage chambers having a first and a second longitudinal dimension which extends between the corresponding filling end and the corresponding discharge end. The first storage chamber has a first inner wall and the second storage chamber has a second inner wall, with the corresponding discharge end opening into a corresponding discharge element in an opening aperture. A venting element is arranged upstream of the opening aperture at at least one of the inner walls of at least one of the first or second storage chambers, with the venting element extending over a maximum of one third of the longitudinal dimension of the storage chamber.

In accordance with a preferred embodiment of the multicomponent cartridge, the venting element is formed as an elevated portion. The venting element can in particular have a respective first elevated portion and a respective second elevated portion. When the venting element is formed as an elevated portion, the discharge of air can take place in a simple manner on the filling of the corresponding storage chamber. The air enclosed between the filler material and the piston forms a bubble which is located as a rule in the proximity of the inner wall of the storage chamber.

The piston contacts the inner wall of the storage chamber via an elastic piston lip, and indeed along the total peripheral dimension of the storage chamber with the exception of the venting element. When the venting element is formed as an elevated portion, the piston lip cannot sealingly follow the curvature of the surface of the inner wall caused by the elevated portion. It results from this that a spacing or gap is formed between the inner wall and the piston lip in the region of the elevated portion. This gap is too narrow for the filler material to be able to be discharged through this gap, in particular when the filler material is viscous. The gap is, however, wide enough to allow the air to escape which has collected in the bubble between the filler material and the piston.

In accordance with a particularly preferred embodiment, the venting element includes two elevated portions which are arranged next to one another viewed in the longitudinal direction of the storage chamber. A passage is formed between the two elevated portions which forms a flow path for the air which is located, on the filling, between the filler material flowing in through the corresponding discharge opening and the piston to be displaced by the filler material in the direction of the filling end. The passage between the elevated portions is in particular also advantageous because a precisely defined gap width can be generated. This means that, for filler material having different rheological properties, the ideal gap width can in each case be set in advance in that the height of the elevated portions is adapted.

At least a respective one of the first and second pistons has a respective piston body and a piston lip, with the piston being able to be held in contact with the inner wall of the corresponding storage chamber by means of the piston lip, with the piston lip filling a ring space between the piston body and the inner wall of the storage chamber, with the corresponding elevated portion of the venting element having a maximum height which is smaller than the spacing of the piston body from the inner wall.

At least one of the first or second elevated portions is formed as a rib. This rib can adopt the shape of a bar, of a projecting edge or of a bead, for example.

The first elevation is preferably arranged substantially parallel to the second elevated portion so that a passage is formed between the first elevated portion and the corresponding second elevated portion. When the passage has a substantially constant width, a substantially unchanging flow cross-section is formed within which the air flows.

The piston has a height which denotes the spacing between the piston surface which faces the filler material and the oppositely disposed piston surface. The length of the venting element is smaller than the height of the piston.

In accordance with a particularly preferred embodiment, the venting element is arranged oppositely disposed the dividing wall. An air bubble which is located between the filler material and the piston is removed by the venting, that is an air-filled hollow space between the filler material and the piston is made to disappear. The compressible medium, the air, located in the hollow space is replaced by an incompressible medium, the filler material. During the escape of the air, pressure is reduced, that is a part of the inner wall of the corresponding storage chamber is exposed to a lower pressure at times than the pressure on the part of the storage chamber which contains the filler material. The wall of the storage chamber is not completely stiff. To prevent distortion of this wall during the venting, the inner wall of the first storage chamber should be relieved such that the resulting force onto the inner wall of the first storage chamber is directed opposite to the resulting force onto the inner wall of the second storage chamber. The two resulting forces thus cancel one another out in the ideal case or at least balance one another in part. A partial balance takes place hen the mixing ratio deviates from 1:1, that is amounts, for example, to 2:1, 4:1 or even 10:1. With a 10-times volume of the first component in the ratio to the second component, the air of the first component enclosed between the filler material and the piston will also amount to a multiple of the enclosed air of the second component. If the named resulting forces balance one another at least in part, distortion of the wall of the storage chamber can be avoided. Such distortion can be disadvantageous because it can result in oblique positions of the piston and thus in leakage of filler material in the extreme case.

The first storage chamber has a first longitudinal axis and the second storage chamber has a second longitudinal axis. The venting element extends parallel to the corresponding longitudinal axis in accordance with a preferred embodiment.

Each of the storage chambers preferably has a peripheral dimension, with the venting element having a width of a maximum of 1/20, preferably 1/50, particularly preferably 1/100 of the peripheral dimension of the corresponding storage chamber. The width of the venting element is in particular limited because the two points at which the piston lip rises from the inner wall to allow the passage of the air should lie as close to one another as possible. It is hereby ensured that the resulting forces acting in the peripheral direction substantially cancel one another out. If the width of the venting element is small, the tangents of a first peripheral point and of a second peripheral point only enclose a small angle to one another at the peripheral dimension of the corresponding inner wall. This has the consequence that the forces which act in the peripheral direction and which are directed opposite to one another along these tangents balance one another for the most part.

The venting element preferably has a height of a maximum of one percent, preferably 0.5%, particularly preferably 0.25%, of the diameter of the storage chamber. With a larger height, the piston lip would rise so far from the inner wall of the corresponding storage chamber that a discharge of filler material through this opening can no longer be precluded.

For the further improvement of the balance of the axial forces and of the forces in the peripheral direction, the venting element can include a first elevated portion and a second elevated portion, with the first elevated portion and the second elevated portion being arranged at a spacing from one another, with the spacing between the first elevated portion and the second elevated portion amounting to a maximum of 1/20, preferably 1/50, particularly preferably 1/100, of the peripheral dimension of the corresponding storage chamber.

The venting element can have at least one section which is inclined toward the longitudinal axis. A discharge of filler material is hereby additionally made more difficult since the discharge path of the filler material becomes larger. This arrangement can in particular be of advantage low-viscosity filler materials. In this case, filler material admittedly moves into the opening between the piston lip and the corresponding elevated portion of the venting element, but it is delayed on the discharge path such that the piston lip has arrived at the end of the venting element before the filler material can be discharged past the piston lip in the direction of the corresponding first and second filling ends. Alternatively or in addition to this, the venting element can have at least one curved section. Furthermore, the venting element can have a changeable height or can also have a width changeable over the length of the venting element.

BRIEF DESCRIPTION OF THE DRAWINGS

The invention will be explained in the following with reference to the drawings. There are shown:

FIG. 1 shows a first embodiment of the multicomponent cartridge 1 in accordance with the invention. Such a multicomponent cartridge is in particular used for the metering of a filler material which includes at least two components which may not come into contact with one another before their common use. The multicomponent cartridge 1 includes a first storage chamber 6 for a first component 8 and a second storage chamber 7 for a second component 9. The first storage chamber 6 is separate from the second storage chamber 7 so that the two components do not come into contact with one another. Such components usually interact with one another as soon as they come into contact with one another, with chemical reactions being able to take place. This interaction of the components is usually the effect which is required in an application; however, this interaction is unwanted as long as the components are being stored. Each of the components can naturally in turn include a mixture of a plurality of substances. The multicomponent cartridge is namely partly stored in a filled condition which will be called the storage condition in the following. It must be ensured for the total period of the storage condition that the two components 8, 9 do not come into contact with one another.

Figure 1:
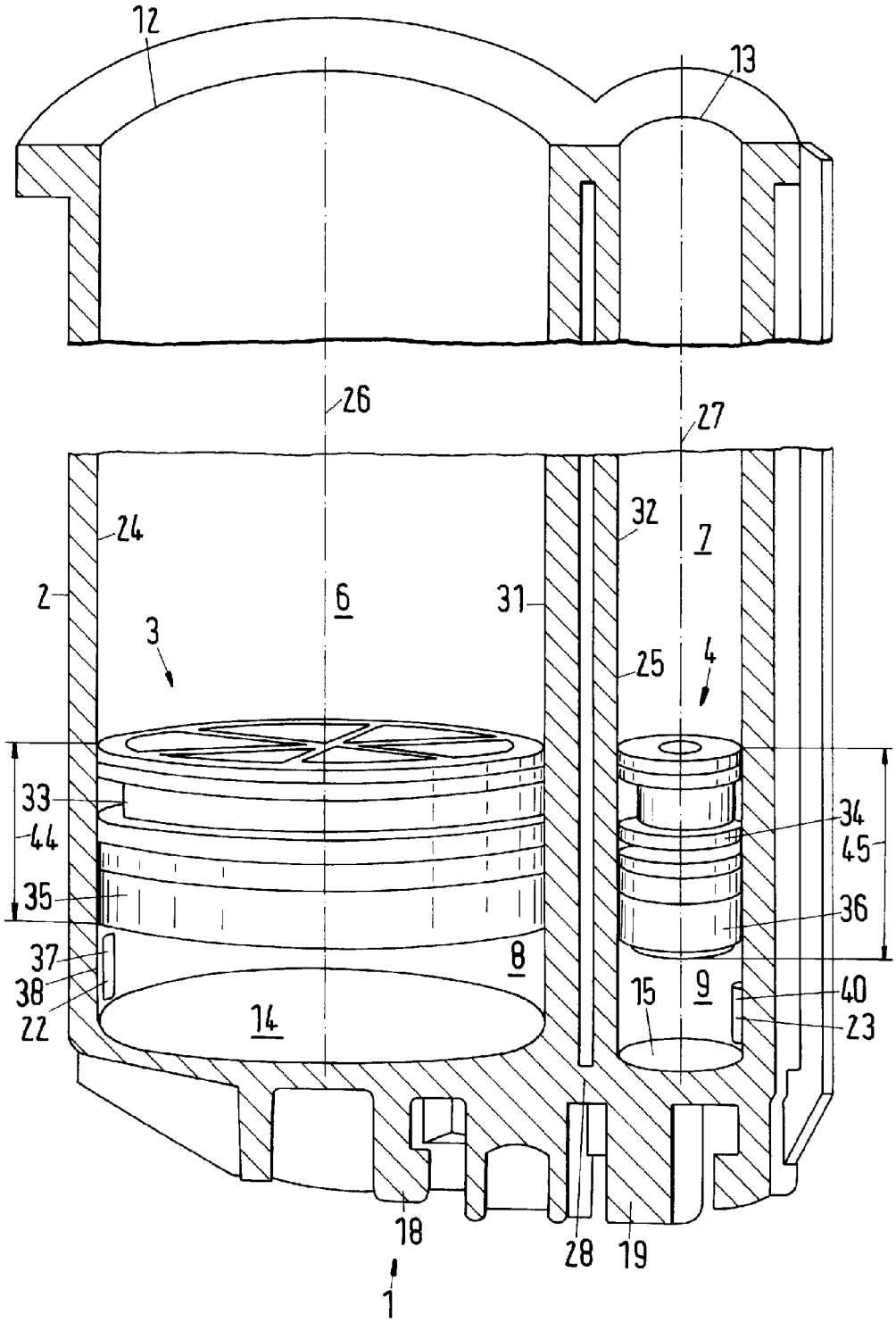
FIG. 1 a section through a multicomponent cartridge in accordance with a first embodiment of the invention.

The multicomponent cartridge has a first filling end 12 and a second filling end 13 via which a first piston 3 and a second piston 4 can be introduced into the corresponding first and second storage chambers 6, 7. The first piston 3 is movably received in the first storage chamber 6. The second piston 4 is movably received in the second storage chamber 7. This first piston 3 slides along a first inner wall 24 of the storage chamber 6 in the direction of the first discharge end 14 when the filler material located in the first storage chamber 6, that is the first component 8, should be expelled.

The second piston 4 slides along a second inner wall 25 of the second storage chamber 7 in the direction of the second discharge end 15 when the filler material located in the second storage chamber 7, that is the second component 9, should be expelled. The first component 8 and the second component 9 are formed as a transparent filler material in this representation so that the arrangement of the first and .second venting elements 22, 23 can be seen more easily.

The first and second pistons 3, 4 are movable by means of a plunger, not shown, for example. The plunger is in particular designed such that it lies on the first and second pistons 3, 4. With the aid of the plunger, the first piston 3 is moved from the first filling end 12 in the direction of the first discharge end 14 and the second piston 4 is moved from the second filling end 13 to the second discharge end 15 when the components 8, 9 are dispensed simultaneously.

The first and second storage chambers 6, 7 are connected to one another at least at the discharge end 14, 15 such that the position of the first storage chamber 6 relative to the second storage chamber 7 is determined. The first storage chamber 6 has a first longitudinal dimension 16 which extends between the first filling end 12 and the first discharge end 14; the second storage chamber 7 has a second longitudinal dimension 17 which extends between the second filling end 13 and the second discharge end 15. The first storage chamber 6 has a first inner wall 24 and the second storage chamber 7 has a second inner wall 25. The first and second inner wall 24, 25 surrounds the corresponding storage chamber 6, 7.

Figure 2:
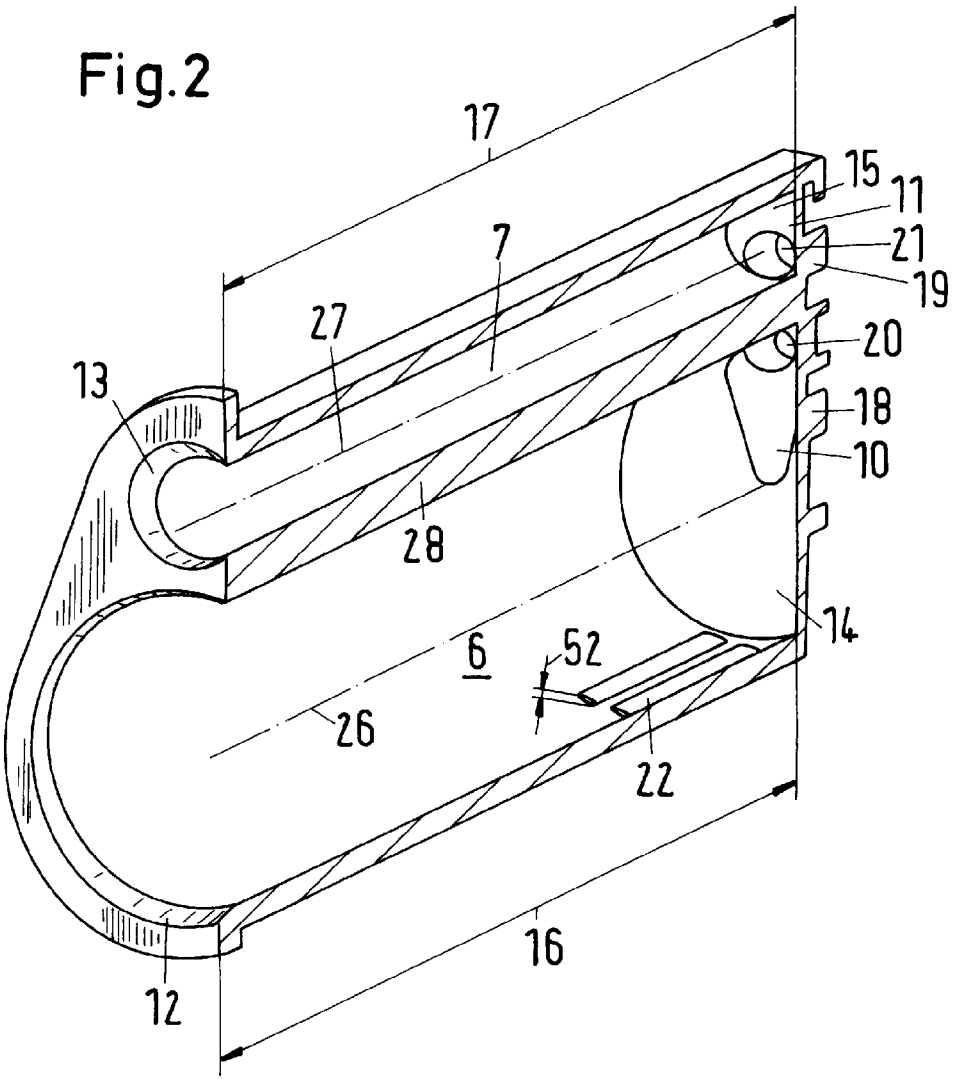
FIG. 2 a view of a part of the multicomponent cartridge in accordance with FIG. 1.

The respective discharge end 14, 15 of the storage chamber 6, 7 opens into a discharge element 18, 19 which contains a corresponding first opening aperture 20 and a second opening aperture 21 which are visible in FIG. 2. The first component 8 is thus expelled from the first storage chamber 6 into the first discharge element 18 and is guided through the first opening aperture 20. The same applies accordingly to the second component 9 which is expelled into the second discharge element 19 and is guided through the second opening aperture 21. Subsequent to the first and second opening apertures 20, 21, two strands of the first and second components 8, 9 are formed which are either supplied to an application in this form or, alternatively to this, are conducted into a mixer which is connected to the first and second discharge elements 18, 19 and in which the two strands are mixed with one another.

A venting element 22, 23 is arranged upstream of the corresponding opening aperture 20, 21 at at least one of the inner walls 24, 25 of at least one of the first or second storage chambers 6, 7, with the venting element 22, 23 extending over a maximum of one third of the longitudinal dimension 16, 17 of the corresponding storage chamber 6, 7. The venting element 22, 23 is provided to allow air enclosed between the corresponding piston 3, 4 and the filler material to escape from the corresponding storage chamber 6, 7. The multicomponent cartridge is in this respect filled via the first discharge element 18 or the second discharge element 19. Before the filling, the piston 3, 4 is located at a position which has the lowest possible spacing from the first or second discharge ends 14, 15. In this position of the pistons, only a small quantity of air is located between the corresponding piston 3, 4 and the discharge end 14, 15 which is here formed as a wall with a corresponding first and second opening aperture 18, 19 only shown in FIG. 2.

When the first component 8 and the second component 9 move into the corresponding storage chamber 6, 7, the air located between the corresponding piston 3, 4 and the filler material is compressed and can escape between the piston 3, 4 and the inner wall 24, 25 through the intermediate space formed by the venting element.

Figure 3A:
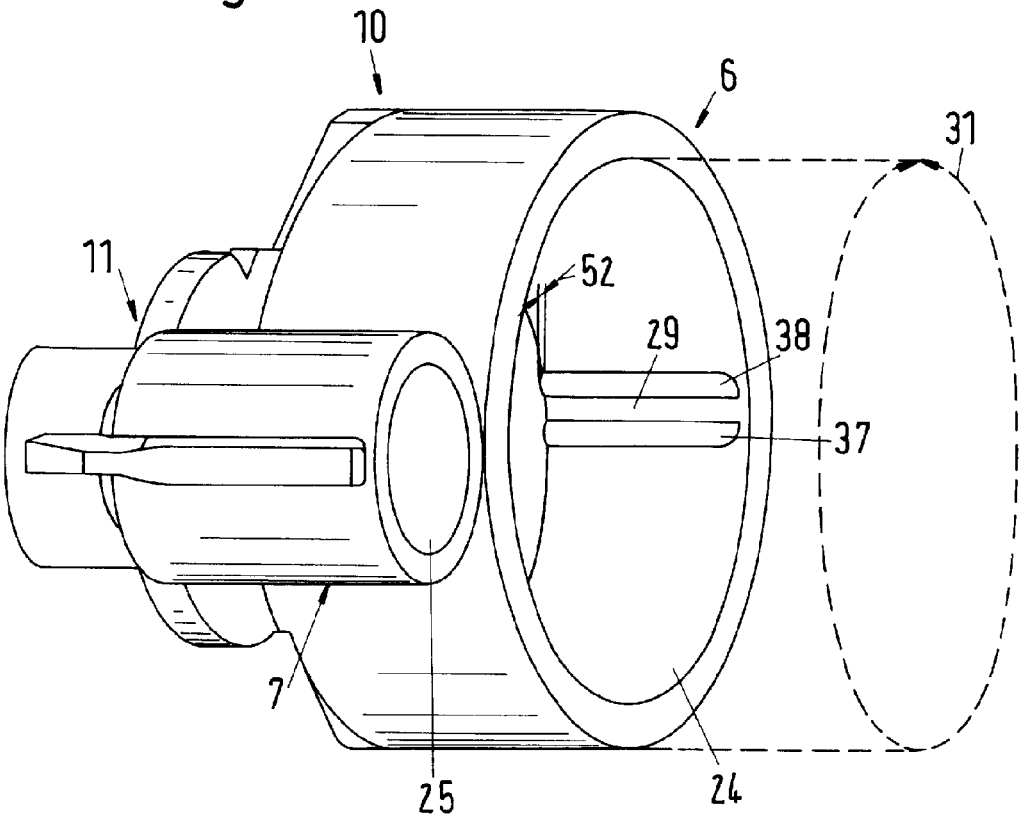
FIG. 3*a* a detail of the multicomponent cartridge in accordance with FIG. 1 in the region of the discharge openings.
Figure 4A:
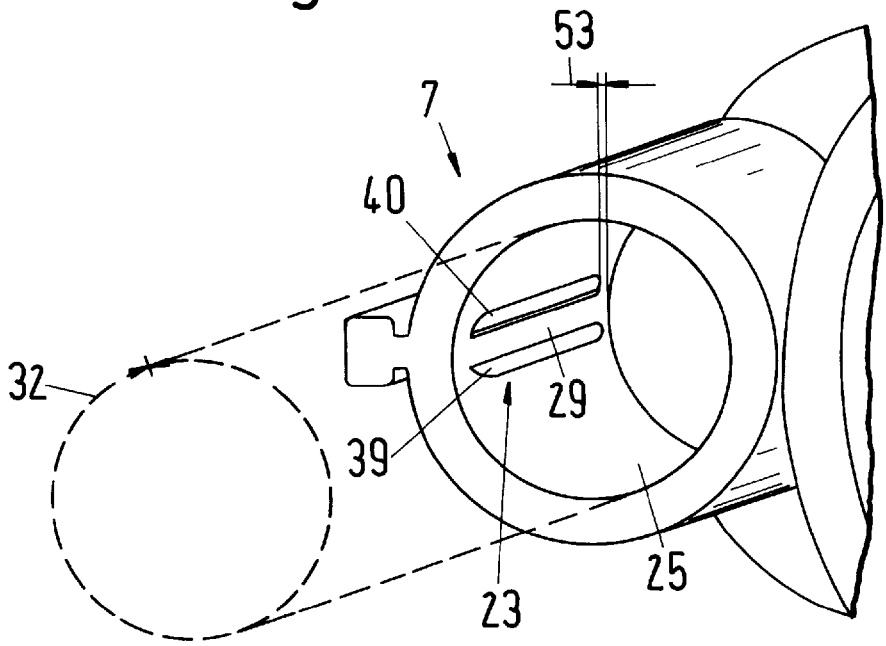
FIG. 4*a* a detail of a discharge opening of a multicomponent cartridge in accordance with FIG. 1.

The venting element 22, 23 can in particular be formed as an elevated portion 37, 38, 39, 40 such as is shown in FIG. 3*a* or FIG. 4*a*. The venting element 60 in accordance with FIG. 5 or the venting element 61 in accordance with FIG. 6 can also be formed as an elevated portion.

The first venting element 22 in accordance with the embodiment in accordance with FIG. 1, FIG. 2 and FIG. 3*a* or FIG. 3*b* includes in each case a first elevated portion 37 and a second elevated portion 38. The second venting element in accordance with FIG. 1, FIG. 2 and FIG. 4*a* or FIG. 4*b* includes in each case a first elevated portion 39 and a second elevated portion 40.

At least one of the respective first and second pistons 3, 4 in each case has a piston body 33, 34 and a piston lip 35, 36, with the piston 3, 4 being able to be held in contact with the corresponding inner wall 24, 25 of the corresponding storage chamber 6, 7 by means of the piston lip. The piston lip 35, 36 thus forms a seal for the filler material by means of which it is prevented that the filler material is discharged from the storage chamber. The piston lip 35, 36 fills a ring space between the piston body 33, 34 and the inner wall of the storage chamber 6, 7.

The contact between the piston lip 35, 36 and the inner wall 24, 25 is interrupted in the region of the venting element 22, 23. The venting element is in particular formed as an elevated portion 37, 38, 39, 40. The piston lip lies on this elevated portion, but cannot sealingly follow the extent of this elevated portion, whereby the aforesaid intermediate space remains present. The corresponding elevated portion 37, 38, 39, 40 of the venting element 22, 23 in particular has a maximum height 52, 53 for this purpose which is less than the spacing of the piston body 33, 34 from the inner wall 24, 25. The piston body 33, 34 has a smaller outer diameter than the diameter of the corresponding storage chamber 6, 7. The piston body 33, 34 slides contactlessly in the interior of the corresponding storage chamber 6, 7; the fluid-tight contact between the piston 3, 4 and the corresponding storage chamber 6, 7 takes place via the piston lip 35, 36.

The first piston 3 has a first height 44 and the second piston 4 has a second height 45. The length 42, 43 of the corresponding venting element 22, 23 is less than the corresponding height 44, 45 of the piston. The length 42, 43 of the venting element is larger than the spacing of the piston lip 35, 36 from the corresponding discharge end 14, 15 when the piston 3, 4 is located in the end position in which it is closest to the corresponding discharge end 14, 15.

It is shown in FIG. 2 that the first storage chamber 6 is arranged next to the second storage chamber 7. The first storage chamber 6 is separated from the second storage chamber 7 by a dividing wall 28 so that the two components 8, 9 can be stored separately. In this embodiment, the first storage chamber 6 extends along the longitudinal axis 26; the second storage chamber 7 along the longitudinal axis 27. The first storage chamber 6 and the second storage chamber 7 open at the first discharge end 14 into a first discharge opening 10 and at the second discharge end 15 into a second discharge opening 11.

The first and the second components 8, 9 can be conducted to a mixer, not shown here, through the first discharge opening 10 and the second discharge opening 11. A plurality of first discharge openings or a plurality of second discharge openings can also be provided between which bars are formed.

In accordance with FIG. 1, FIG. 2, FIG. 3*a* and FIG. 4*a*, the venting element 22, 23 is arranged opposite the dividing wall 28. This means that the venting takes place at a point which is as far away from the dividing wall 28 as possible.

The first storage chamber 6 has a first longitudinal axis 26 and the second storage chamber 7 has a second longitudinal axis 27, with the venting element 22, 23 extending parallel to the corresponding longitudinal axis 26, 27 in accordance with one of FIG. 1 to FIG. 4*b*. The air is hereby substantially expelled in a direction which is parallel to the corresponding longitudinal axis.

Each of the storage chambers 6, 7 has a peripheral dimension 31, 32, with the venting element 22, 23 having a width of a maximum of 1/20, preferably 1/50, particularly preferably 1/100, of the peripheral dimension 31, 32 of the corresponding storage chamber 6, 7.

The venting element 22, 23 in particular has a height of a maximum of one percent, preferably 0.5%, particularly preferably 0.25%, of the diameter of the storage chamber 6, 7.

The first elevated portion 37, 39 and the second elevated portion 38, 40 are arranged at a spacing 46, 47 from one another, with the spacing 46, 47 between the first elevated portion 37, 39 and the second elevated portion 38, 40 amounting to a maximum of 1/20, preferably 1/50, particularly preferably 1/100, of the peripheral dimension 31, 32 of the corresponding storage chamber 6, 7.

FIG. 3*a* shows a detail of the multicomponent cartridge in accordance with FIG. 1 in the region of the first and second discharge openings 10, 11. The first venting element 22 is shown along the partly shown first inner wall 24 of the first storage chamber 6.

Figure 3B:
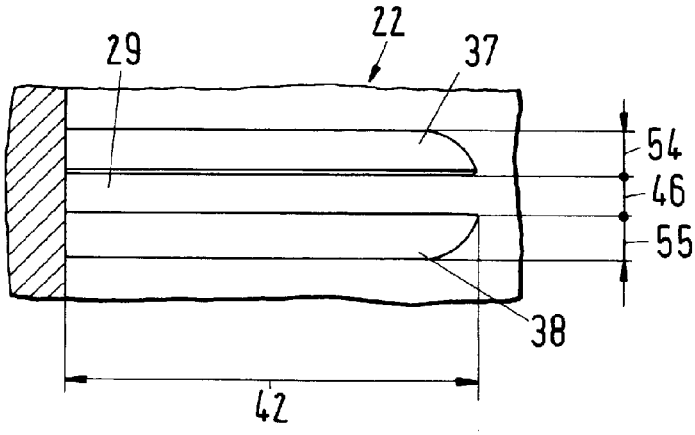
FIG. 3*b* a detail of FIG. 3*a;*

FIG. 3*b* is a detail of FIG. 3*a* which shows the venting element 22 in a magnified scale. One of the first elevated portions 37, 38 is in particular formed as a rib. The first elevated portion 37 is arranged parallel to the second elevated portion 38 so that a passage 29 is formed between the first elevated portion 37 and the second elevated portion 38.

FIG. 4*a* shows a detail of the second discharge opening 11 of a multicomponent cartridge in accordance with FIG. 1. The second venting element 23 is shown along the partly shown second inner wall 25 of the second storage chamber 7.

Figure 4B:
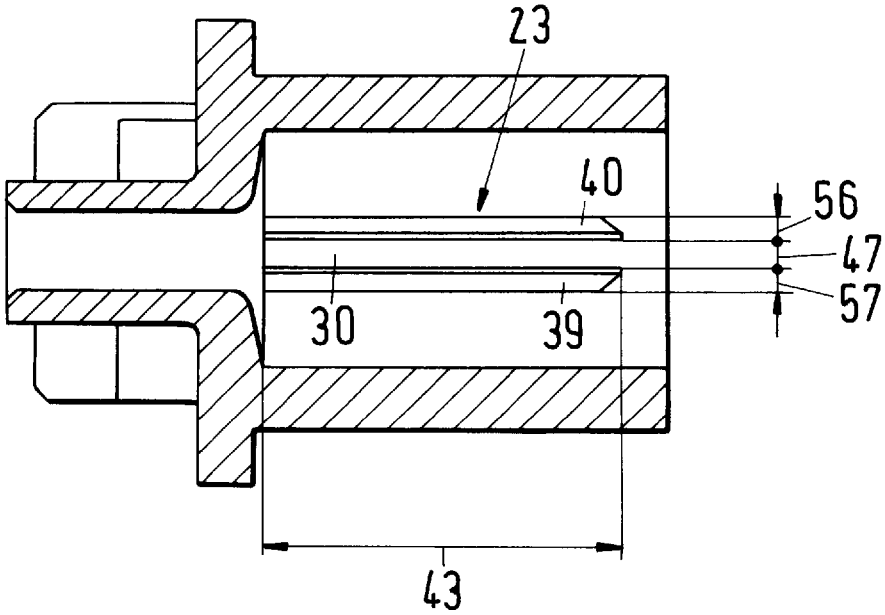
FIG. 4*b* a detail of FIG. 4*a;*

FIG. 4*b* shows a detail of FIG. 4*a* which shows the second venting element 23 in a magnified scale. One of the second elevated portions 39, 40 is in particular formed as a rib. The first elevated portion 39 is arranged parallel to the second elevated portion 40 so that a passage 30 is formed between the first elevated portion 39 and the second elevated portion 40.

Figure 5:
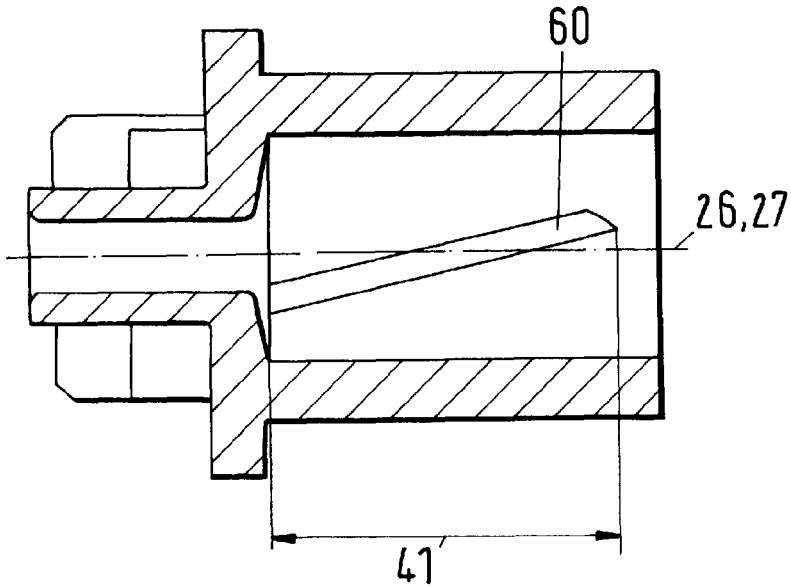
FIG. 5 a variant of a venting apparatus in accordance with the invention.

FIG. 5 shows a variant of a venting apparatus in accordance with the invention. The venting element 22, 23 has at least one section 41, 48, 49 which is inclined with respect to the longitudinal axis 26, 27.

Figure 6:
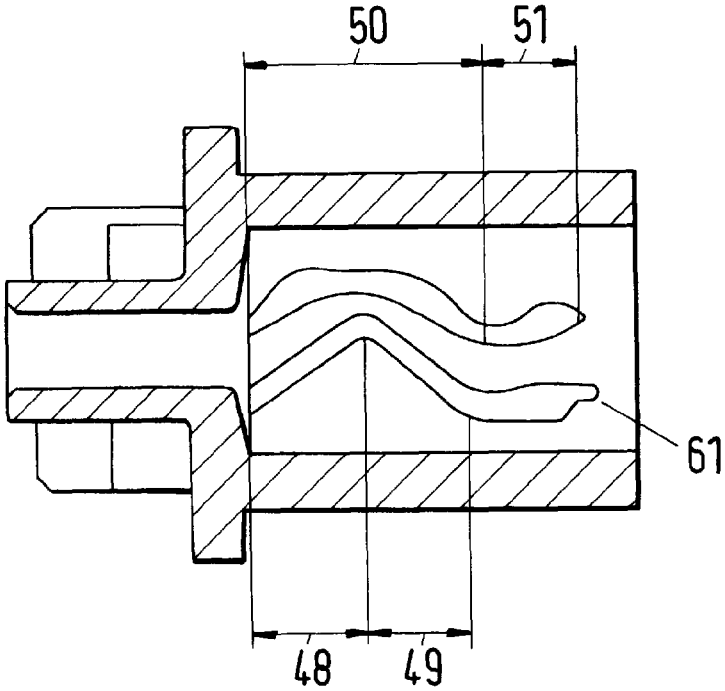
FIG. 6 a further variant of a venting apparatus in accordance with the invention.

FIG. 6 shows a further variant of a venting apparatus in accordance with the invention. The venting element 22, 23 has at least one section 41, 48, 49 which has at least one curved section 50, 51.

The venting element 22, 23 in accordance with each of the preceding embodiments can have a changeable height 52, 53.

The venting element 22, 23 in accordance with each of the preceding embodiments can have a width 54, 55 changeable over its length 42, 43.

The invention claimed is:

1. A multicomponent cartridge, including a first storage chamber for a first component and a second storage chamber for a second component, wherein the first storage chamber is separate from the second storage chamber, with the first storage chamber being arranged next to the second storage chamber, with a first piston being movably received in the first storage chamber and a second piston being movably received in the second storage chamber, wherein the first piston and the second piston each having a piston height, with each of the first and second storage chambers having a respective filling end and a respective discharge end and the first and second storage chambers being connected to one another at least at the discharge end, with the first and second storage chambers each having a storage chamber longitudinal dimension which extends between a corresponding filling end and a corresponding discharge end, with the first storage chamber having a first inner wall and the second storage chamber having a second inner wall, with the corresponding discharge end opening into a first discharge element in a first opening aperture and into a second discharge element of a second opening aperture, wherein a venting element is arranged upstream of the corresponding opening aperture on at least one of the inner walls of at least one of the first and second storage chambers, with the venting element extending over a maximum of one third of the storage chamber longitudinal dimension, and wherein a venting length of the venting element is smaller than the piston height, wherein the venting element includes a first venting element that includes a respective first elevated portion and a second venting element that includes a respective second elevated portion, and wherein the first elevated portion is arranged parallel to the second elevated portion so that a passage is formed between the first elevated portion and the second elevated portion.

2. The multicomponent cartridge of claim 1, wherein at least one each of the first and second pistons has a respective piston body and a piston lip with the piston being able to be held in contact with the inner wall of the corresponding storage chamber by means of the piston lip, with the piston lip filling a ring space between the piston body and the inner wall of the storage chamber, with the corresponding elevated portion of the venting element having a maximum height which is less than a spacing of the piston body from the inner wall.

3. The multicomponent cartridge of claim 1, wherein at least one of the first and second elevated portions is formed as a rib.

4. The multicomponent cartridge of claim 1, wherein the venting element is arranged opposite a dividing wall.

5. The multicomponent cartridge of claim 1, wherein the first storage chamber has a first longitudinal axis and the second storage chamber has a second longitudinal axis, with the venting element extending parallel to a corresponding longitudinal axis.

6. The multicomponent cartridge of claim 1, wherein each of the first and second storage chambers each has a storage chamber peripheral dimension, with the venting element having a venting width of a maximum of any one of 1/20, 1/50, and 1/100, of the storage chamber peripheral dimension.

7. The multicomponent cartridge of claim 1, wherein each of the first and second storage chambers each has a storage chamber diameter, wherein the venting element has a venting height of a maximum of any one of one percent, 0.5%, and 0.25%, of the storage chamber diameter.

8. The multicomponent cartridge of claim 1, wherein each of the first and second storage chambers each has a storage chamber peripheral dimension, wherein the first elevated portion and the second elevated portion are arranged at a spacing from one another, with the spacing between the first elevated portion and the second elevated portion amounting to a maximum of any one of 1/20, 1/50, and 1/100, of the storage chamber peripheral dimension.

9. The multicomponent cartridge of claim 1, wherein the venting element has a changeable height.

10. The multicomponent cartridge of claim 1, wherein the venting element has a venting width changeable over the venting length.

11. A multicomponent cartridge, including a first storage chamber for a first component and a second storage chamber for a second component, wherein the first storage chamber is separate from the second storage chamber, with the first storage chamber being arranged next to the second storage chamber, with a first piston being movably received in the first storage chamber and a second piston being movably received in the second storage chamber, wherein the first piston and the second piston each having a piston height, with each of the first and second storage chambers having a respective filling end and a respective discharge end and the first and second storage chambers being connected to one another at least at the discharge end, with the first and second storage chambers each having a storage chamber longitudinal dimension which extends between a corresponding filling end and a corresponding discharge end, with the first storage chamber having a first inner wall and the second storage chamber having a second inner wall, with the corresponding discharge end opening into a first discharge element in a first opening aperture and into a second discharge element of a second opening aperture, wherein a venting element is arranged upstream of the corresponding opening aperture on at least one of the inner walls of at least one of the first and second storage chambers, with the venting element extending over a maximum of one third of the storage chamber longitudinal dimension, and wherein a venting length of the venting element is smaller than the piston height, wherein the venting element includes a first venting element that includes a respective first elevated portion and a second venting element that includes a respective second elevated portion, wherein the first elevated portion is arranged parallel to the second elevated portion so that a passage is formed between the first elevated portion and the second elevated portion, and wherein the venting element has at least one section which is at least one of inclined with respect to a longitudinal axis and has at least one curved section.

12. The multicomponent cartridge of claim 11, wherein at least one each of the first and second pistons has a respective piston body and a piston lip with the piston being able to be held in contact with the inner wall of the corresponding storage chamber by means of the piston lip, with the piston lip filling a ring space between the piston body and the inner wall of the storage chamber, with the corresponding elevated portion of the venting element having a maximum height which is less than a spacing of the piston body from the inner wall.

13. The multicomponent cartridge of claim 11, wherein at least one of the first and second elevated portions is formed as a rib.

14. The multicomponent cartridge of claim 11, wherein the venting element is arranged opposite a dividing wall.

15. The multicomponent cartridge of claim 11, wherein the first storage chamber has a first longitudinal axis and the second storage chamber has a second longitudinal axis, with the venting element extending parallel to a corresponding longitudinal axis.

16. The multicomponent cartridge of claim 11, wherein each of the first and second storage chambers each has a storage chamber peripheral dimension, with the venting element having a venting width of a maximum of any one of 1/20, 1/50, and 1/100, of the storage chamber peripheral dimension.

17. The multicomponent cartridge of claim 12, wherein each of the first and second storage chambers each has a storage chamber diameter, wherein the venting element has a venting height of a maximum of any one of one percent, 0.5%, and 0.25%, of the storage chamber diameter.

18. The multicomponent cartridge of claim 11, wherein each of the first and second storage chambers each has a storage chamber peripheral dimension, wherein the first elevated portion and the second elevated portion are arranged at a spacing from one another, with the spacing between the first elevated portion and the second elevated portion amounting to a maximum of any one of 1/20, 1/50, and 1/100, of the storage chamber peripheral dimension.

19. The multicomponent cartridge of claim 11, wherein the venting element has a changeable height.

20. The multicomponent cartridge of claim 11, wherein the venting element has a venting width changeable over the venting length.

* * * * *